US008336509B2

(12) United States Patent
Kim

(10) Patent No.: US 8,336,509 B2
(45) Date of Patent: Dec. 25, 2012

(54) FLAP CONTROL APPARATUS OF VEHICLE AND CONTROL METHOD THEREOF

(75) Inventor: In Cheol Kim, Gyeonggi-do (KR)

(73) Assignee: Hyundai Mobis Co., Ltd., Seoul (KR)

( * ) Notice: Subject to any disclaimer, the term of this patent is extended or adjusted under 35 U.S.C. 154(b) by 376 days.

(21) Appl. No.: 12/770,310

(22) Filed: Apr. 29, 2010

(65) Prior Publication Data

US 2011/0120395 A1 May 26, 2011

(30) Foreign Application Priority Data

Nov. 23, 2009 (KR) ..... 10-2009-0113435

(51) Int. Cl.
*F01P 7/02* (2006.01)

(52) U.S. Cl. ..... 123/41.04; 123/41.15; 180/68.1; 236/35.2

(58) Field of Classification Search ..... 123/41.04, 123/41.06, 41.15, 41.59, 41.61, 41.62, 41.7, 123/198 D; 180/68.1, 68.4, 68.6; 236/35.2, 236/35.3

See application file for complete search history.

(56) References Cited

U.S. PATENT DOCUMENTS

| | | | | |
|---|---|---|---|---|
| 3,759,056 | A * | 9/1973 | Graber | 62/183 |
| 4,779,577 | A * | 10/1988 | Ritter et al. | 123/41.05 |
| 5,205,484 | A * | 4/1993 | Susa et al. | 236/35.3 |
| 6,142,108 | A * | 11/2000 | Blichmann | 123/41.05 |
| 6,588,380 | B2 * | 7/2003 | Ries-Mueller | 123/41.05 |
| 7,498,926 | B2 * | 3/2009 | Browne et al. | 340/425.5 |
| 7,766,111 | B2 * | 8/2010 | Guilfoyle et al. | 180/68.1 |
| 8,161,919 | B2 * | 4/2012 | Klotz et al. | 123/41.04 |

* cited by examiner

*Primary Examiner* — Noah Kamen
*Assistant Examiner* — Hung Q Nguyen
(74) *Attorney, Agent, or Firm* — Saliwanchik, Lloyd & Eisenschenk

(57) ABSTRACT

A flap control apparatus of a vehicle and a control method thereof are disclosed. The flap control apparatus can control flaps, disposed at the front side of the vehicle to adjust inflow of air into a radiator, and can perform a fail-safe operation by releasing a corresponding flap from a locked state so that the corresponding flap can be opened by drive wind pressure upon occurrence of a malfunction making the flaps substantially non-operative, thereby preventing the engine from overheating.

7 Claims, 3 Drawing Sheets

FLAP CONTROL APPARATUS OF VEHICLE AND CONTROL METHOD THEREOF

CROSS-REFERENCE TO RELATED APPLICATION

This application claims the benefit under 35 U.S.C.§119 of Korean Patent Application No. 10-2009-0113435, filed Nov. 23, 2009, which is hereby incorporated by reference in its entirety.

BACKGROUND OF THE INVENTION

1. Field of the Invention

The present invention relates to a flap control apparatus of a vehicle and a control method thereof and, more particularly, to a flap control apparatus of a vehicle that can control flaps, disposed at a front side of the vehicle to adjust inflow of air into a radiator, and can carry out a fail-safe operation to allow a corresponding flap to be opened by drive wind pressure by releasing the corresponding flap from a locked state upon occurrence of a malfunction making the flaps substantially non-operative, and a control method thereof.

2. Description of the Related Art

In general, a radiator is a heat exchanger provided to a vehicle to emit heat from a water-cooling type engine to air and cools the cooling water which absorbs heat while passing through a cooling water passage in a cylinder block and a cylinder head.

The radiator cools the cooling water heated in the engine by allowing the cooling water to come into contact with air while passing through a heat sink, and has a high heat dissipation amount per unit area and low resistance to the flow of cooling water.

To improve cooling effects, the radiator is located at a front side of a vehicle to remove heat using drive wind. The radiator includes metal plates, which are made of a material having high thermal conductivity and overlap each other to have a gap therebetween, and a tube through which cooling water passes, thereby improving the cooling effect.

However, when the vehicle is in a cold state, cold air is unnecessarily introduced from outside into the radiator during driving of the vehicle, so that time for heating the engine is delayed, thereby not only deteriorating engine performance, but also increasing emissions.

In recent years, on-off controllable flaps are provided to a back surface of a front bumper grill of the vehicle to control the amount of air flowing into the radiator depending on temperature variation of cooling water for the engine, thereby improving both engine performance and air cooling performance by ensuring a sufficient time for heating the engine.

It should be noted that the above description is provided for understanding of the background of the invention and is not a description of a conventional technique well-known in the art.

In operation of the flaps, an engine controller determines an operating condition of the flaps and issues an opening or closing command in accordance with the operating condition so that a drive motor is operated to open or close the flaps by links connected to the flaps in response to the opening or closing command.

Here, the amount of inflow air necessary for cooling the engine is liable to become insufficient, causing overheating of the engine in the event that the drive motor does not receive the opening or closing command from the engine controller, in the event that the drive motor does not operate normally, in the event that the flaps do not substantially move despite normal operation of the drive motor, in the event that power is interrupted to secure the flaps in a closed state, or the like.

BRIEF SUMMARY

The present invention is conceived to solve the above problems of the related art, and an aspect of the present invention is to provide a flap control apparatus of a vehicle that can control flaps, disposed at a front side of the vehicle to control the amount of air flowing into a radiator, and carry out a fail-safe operation to allow a corresponding flap to be opened by drive wind pressure by releasing the corresponding flap from a locked state upon occurrence of malfunction making the flaps substantially non-operative, and a control method thereof.

In accordance with one aspect of the invention, a flap control apparatus of a vehicle includes: upper and lower flaps disposed at a front side of the vehicle to adjust inflow of air into the vehicle; a drive unit opening and closing the upper flap; a locking unit locking the lower flap so as not to be opened by drive wind pressure; a movement detection sensor detecting movement of the upper flap resulting from an opening or closing behavior of the upper flap; an engine controller determining an operating condition of the upper and lower flaps; and a drive controller operating the drive unit and the locking unit in response to a drive condition signal from the engine controller and performing a fail-safe operation for the drive unit and the locking unit according to a detection value of the movement detection sensor and a communication state with the engine controller.

The locking unit may be released from a locked state when power supply to the locking unit is interrupted.

The engine controller may interrupt power supply to the drive controller when the communication state between the engine controller and the drive controller is not normal.

The drive controller may send a state signal to the engine controller after operating the drive unit and the locking unit, and may send a fail signal to the engine controller upon the fail-safe operation.

The engine controller may output an alarm signal when receiving the fail signal from the drive controller or when interrupting power supply to the drive controller.

The apparatus may further include an alarm unit issuing an alarm when the alarm signal is output from the engine controller.

The upper flap may be open and the lower flap may be released from a locked state during the fail-safe operation.

In accordance with an aspect of the invention, a control method of a flap control apparatus of a vehicle includes: determining a communication state with an engine controller; opening an upper flap and releasing a lower flap from a locked state when the communication state is not normal; receiving an opening or closing signal when the communication state is normal; operating the upper and lower flaps according to the received opening or closing signal; detecting movement of the upper flap resulting from an opening or closing behavior of the upper flap; outputting a state signal to the engine controller when the movement of the upper flap is detected; and releasing the lower flap from the locked state and outputting a fail signal to the engine controller, when the movement of the upper flap is not detected.

The method may further include: determining, by the engine controller, the communication state with the drive controller, followed by interrupting power supply to the drive controller if the communication state is not normal; and outputting an alarm signal when interrupting the power supply to the drive controller or when receiving the fail signal from the drive controller.

BRIEF DESCRIPTION OF THE DRAWINGS

The above and other aspects, features and advantages of the invention will become apparent from the following detailed description in conjunction with the accompanying drawings, in which.

DETAILED DESCRIPTION

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
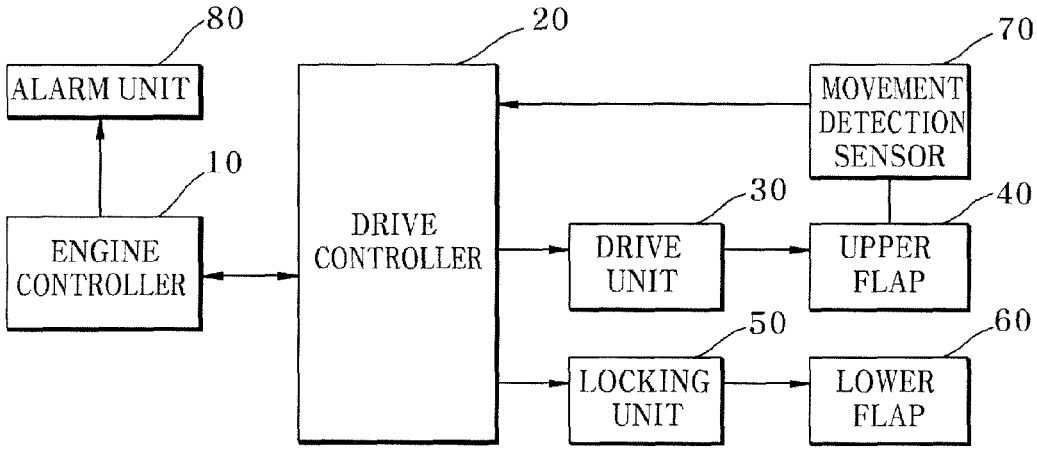
FIG. 1 is a block diagram of a flap control apparatus of a vehicle in accordance with one embodiment of the present invention.

FIG. 1 is a block diagram of a flap control apparatus of a vehicle in accordance with one embodiment of the present invention.

Referring to FIG. 1, the flap control apparatus of a vehicle according to this embodiment includes an upper flap 40, a lower flap 60, a drive unit 30, a locking unit 50, a movement detection sensor 70, an engine controller 10, a drive controller 20, and an alarm unit 80.

The upper and lower flaps 40, 60 are located at a front side of the vehicle to adjust inflow of air into the vehicle.

The drive unit 30 serves to open and close the upper flap 40 and includes a drive motor (not shown) and a drive gear (not shown).

The locking unit 50 includes a solenoid for locking the lower flap 60 to prevent the lower flap 60 from being opened by drive wind pressure. With this configuration, the locking unit 50 locks the lower flap 60 during application of power to the locking unit 50 and releases the lower flap 60 from a locked state so as to allow the lower flap 60 to be opened by the drive wind pressure upon interruption of the power thereto.

The movement detection sensor 70 detects the movement of the upper flap 40 resulting from an opening or closing behavior thereof. The movement detection sensor 70 may detect the movement of the upper flap 40 based on voltage variation caused by variable resistance using a potentiometer (not shown).

The engine controller 10 determines an operating condition of the upper and lower flaps 40, 60 by comparing the temperature of cooling water of the engine, or for a hybrid vehicle, the temperature of an inverter with a predetermined value, and outputs an opening or closing command corresponding to the operating condition.

Further, the engine controller 10 checks a communication state with the drive controller 20 via CAN communication with the drive controller 20. If there is a communication delay of 500 msec. or more, the engine controller 10 determines that the state of the drive controller 20 cannot be recognized, and performs a fail-safe operation by interrupting power supply to the power controller 20.

When the power supply to the drive controller 20 is interrupted, power to the locking unit 50 is interrupted to release the locking unit 50 from a locked state, so that the lower flap 60 is opened by drive wind pressure to allow the engine of the vehicle to be cooled.

Further, the engine controller 10 outputs an alarm signal when receiving the fail signal from the drive controller 20 or when the power to the drive controller 20 is interrupted.

When the alarm signal is output from the engine controller 10, the alarm unit 80 turns on an alarm light or issues an alarm sound to inform a driver of a malfunction state of the vehicle.

The drive controller 20 operates the drive unit 30 and the locking unit 50 in response to the opening or closing command sent from the engine controller 10 corresponding to the operating condition, and carries out a fail-safe operation for the drive unit 30 and the locking unit 50 according to a detection value of the movement detection sensor 70 and the communication state with the engine controller 10.

Upon the fail-safe operation, the drive unit 30 is operated to open the upper flap 40 and interrupts power to the locking unit 50 to release the lower flap 60 from a locked state.

At this time, the upper flap 40 may not be operated due to malfunction thereof.

After operating the drive unit 30 and the locking unit 50 in accordance with the opening or closing command, the drive controller 20 sends a state signal to the engine controller 10. Here, in the fail-safe operation, the drive controller 20 may send a fail signal to the engine controller 10 for warning.

Meanwhile, the drive controller 20 may open or close the upper flap 40 while linearly adjusting the degree of opening or closing by operating the drive unit 30 while checking an open or closed degree of the upper flap 40 based on the detection value of the movement detection sensor 70.

Figure 2:
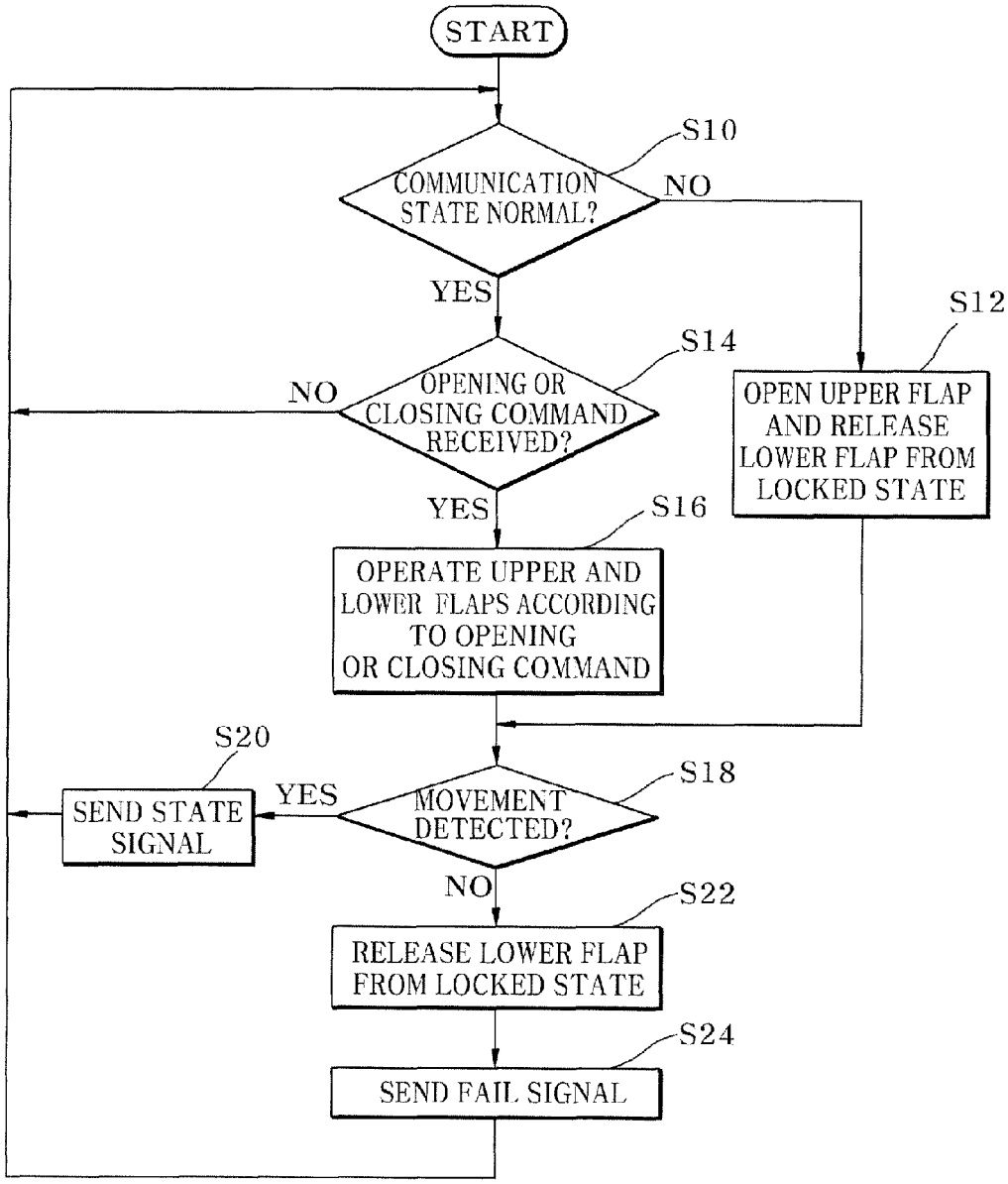
FIG. 2 is a flowchart of a control method of a flap control apparatus of a vehicle in accordance with one embodiment of the present invention.
Figure 3:
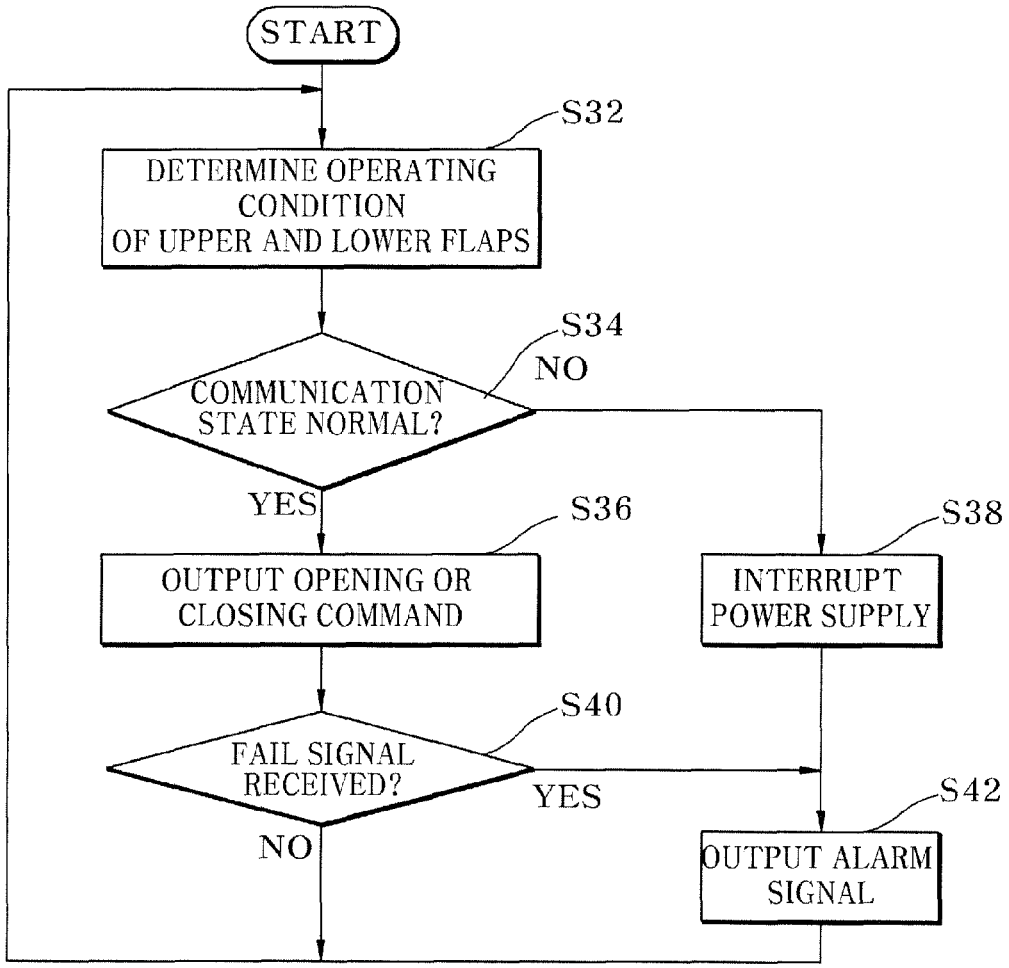
FIG. 3 is a flowchart of a control method of a flap control apparatus of a vehicle in accordance with one embodiment of the present invention.

FIGS. 2 and 3 are flowcharts of a control method of the flap control method in accordance with one embodiment of the invention. Specifically, FIG. 2 is a flowchart of operation of the drive controller and FIG. 3 is a flowchart of operation of the engine controller.

As shown in FIG. 2, first, the drive controller 20 checks a communication state with the engine controller 10 in S10.

If there is a communication delay of 500 msec. or more during CAN communication with the engine controller 10 or if there is a communication failure such as reception failure of a signal from the engine controller 10, it cannot be checked whether the engine is in an overheated state. In this case, the drive controller 20 performs a fail-safe operation by opening the upper flap 40 while releasing the lower flap 60 from a locked state, thereby enabling the engine to be cooled, in S12.

At this time, if the communication state is normal, the drive controller 20 receives an opening or closing command sent from the engine controller 10 in S14.

Then, the drive controller 20 operates the drive unit 30 in response to the opening or closing command from the engine controller 10 to open or close the upper flap 40 or to operate or release the locking unit 50 so that the lower flap 60 is opened by drive wind pressure, in S16.

As such, when the drive controller 20 operates the upper flap 40 through the drive unit 30, the movement detection sensor detects the movement of the upper flap 40 resulting from an opening or closing behavior thereof in S18.

If the movement of the upper flap 40 is detected, the drive controller 20 outputs a normal state signal to the engine controller 10 in S20.

However, if a drive motor of the drive unit 30 is damaged or the upper flap 40 is fixed or to frozen in place, the movement of the upper flap 40 will not be detected. In this case, the drive controller 20 interrupts power to the locking unit 50 to release the lower flap 60 from a locked state for the fail-safe operation in S22.

Additionally, the drive controller 20 outputs a fail signal to the engine controller 10 to inform a vehicle driver of the current state in S24.

Referring to FIG. 3, the engine controller 10 determines an operating condition of the upper and lower flaps 40, 60 by comparing the temperature of cooling water of the engine, or for a hybrid vehicle, the temperature of an inverter with a predetermined value, in S32.

Then, the engine controller 10 determines a communication state with the drive controller 20, and outputs an opening or closing command corresponding to the operating condition when normally receiving a state signal from the drive controller 20 within a predetermined time.

If the communication state is not normal, however, the engine controller 10 determines that the drive controller 20 is malfunctioning, and interrupts power supply to the drive controller 20 for a fail-safe operation in S38.

When the power supply to the drive controller 20 is interrupted, power to the locking unit 50 is interrupted to release the lower flap 60 from a locked state so that the lower flap 60 can be opened by drive wind pressure.

When the fail-safe operation is carried out, the engine controller 10 outputs an alarm signal to notify a driver of the malfunction of the drive controller 20 in S42.

On the other hand, when the opening or closing signal is output to the drive controller 20 by determining that the communication state is normal, the engine controller 10 determines whether a fail signal from the drive controller 20 is received, in S40.

If the fail signal is received, the engine controller 10 outputs an alarm signal to notify a driver of the fail-safe operation in S42.

According to the embodiments of the invention, the flap control apparatus can control flaps, disposed at the front side of the vehicle to adjust inflow of air into a radiator, and carries out a fail-safe operation to allow the corresponding flap to be opened by drive wind pressure of the vehicle by releasing the corresponding flap from a locked state upon occurrence of a malfunction making the flaps substantially non-operative.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

What is claimed is:

1. A flap control apparatus of a vehicle comprising:

upper and lower flaps disposed at a front side of the vehicle to adjust inflow of air into the vehicle;

a drive unit opening and closing the upper flap;

a locking unit locking the lower flap so as not to be opened by drive wind pressure;

a movement detection sensor detecting movement of the upper flap resulting from an opening or closing behavior of the upper flap;

an engine controller determining an operating condition of the upper and lower flaps; and a drive controller operating the drive unit and the locking unit in response to a drive condition signal from the engine controller and performing a fail-safe operation for the drive unit and the locking unit according to a detection value of the movement detection sensor and a communication state with the engine controller, wherein the drive controller opens the upper flap and releases the lower flap from a locked state when the communication state is not normal, and wherein the drive controller releases the lower flap from the locked state and outputs a fail signal to the engine controller when the movement of the upper flap is not detected.

2. The flap control apparatus according to claim 1, wherein the locking unit is released from a locked state when power supply to the locking unit is interrupted.

3. The flap control apparatus according to claim 1, wherein the engine controller interrupts power supply to the drive controller when the communication state between the engine controller and the drive controller is not normal.

4. The flap control apparatus according to claim 1, wherein the drive controller sends a state signal to the engine controller after operating the drive unit and the locking unit, and sends the fail signal to the engine controller upon the fail-safe operation.

5. The flap control apparatus according to claim 4, wherein the engine controller outputs an alarm signal when receiving the fail signal from the drive controller or when interrupting power supply to the drive controller.

6. The flap control apparatus according to claim 5, further comprising:

an alarm unit issuing an alarm when the alarm signal is output from the engine controller.

7. The flap control apparatus according to claim 1, wherein the upper flap is open and the lower flap is released from a locked state during the fail-safe operation.

* * * * *